US009631507B2

(12) United States Patent
Gurao

(10) Patent No.: US 9,631,507 B2
(45) Date of Patent: Apr. 25, 2017

(54) GAS TURBINE SEALING BAND ARRANGEMENT HAVING A LOCKING PIN

(71) Applicant: Siemens Energy, Inc., Orlando, FL (US)

(72) Inventor: Manish S. Gurao, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 14/330,301

(22) Filed: Jul. 14, 2014

(65) Prior Publication Data

US 2016/0010478 A1 Jan. 14, 2016

(51) Int. Cl.

| | |
|---|---|
| ***F01D 11/00*** | (2006.01) |
| *F01D 5/06* | (2006.01) |
| *F01D 5/02* | (2006.01) |

(52) U.S. Cl.

CPC ..... *F01D 11/005* (2013.01); *F01D 11/001* (2013.01); *F01D 5/02* (2013.01); *F01D 5/06* (2013.01); *F01D 5/063* (2013.01); *F01D 5/066* (2013.01); *F05D 2230/64* (2013.01)

(58) Field of Classification Search

CPC ..... F01D 11/005; F01D 11/08; F01D 5/06; F01D 5/063; F01D 5/02; F01D 5/066; F05D 2240/55; F05D 2230/64

See application file for complete search history.

(56) References Cited

U.S. PATENT DOCUMENTS

| | | | | |
|---|---|---|---|---|
| 3,966,356 | A * | 6/1976 | Irwin | 415/173.3 |
| 4,311,432 | A * | 1/1982 | Kildea | 415/134 |
| 4,650,394 | A * | 3/1987 | Weidner | 415/115 |
| 5,141,395 | A * | 8/1992 | Carroll et al. | 415/196 |
| 5,387,082 | A * | 2/1995 | Matyscak | 415/209.2 |
| 5,865,600 | A * | 2/1999 | Mori et al. | 416/198 A |
| 6,315,301 | B1 * | 11/2001 | Umemura et al. | 277/545 |
| 7,549,845 | B2 * | 6/2009 | Uwami et al. | 416/198 A |
| 2004/0120806 | A1 * | 6/2004 | Darkins et al. | 415/139 |
| 2005/0249588 | A1 * | 11/2005 | Ferra et al. | 415/170.1 |
| 2009/0081033 | A1 * | 3/2009 | Schiavo et al. | 415/200 |
| 2009/0148279 | A1 * | 6/2009 | Shaefer et al. | 415/173.5 |
| 2009/0191050 | A1 * | 7/2009 | Nereim et al. | 415/173.7 |
| 2010/0074731 | A1 * | 3/2010 | Wiebe et al. | 415/173.4 |
| 2012/0082540 | A1 * | 4/2012 | Dziech et al. | 415/173.1 |
| 2013/0106066 | A1 * | 5/2013 | Sarawate et al. | 277/641 |
| 2014/0119899 | A1 * | 5/2014 | Nereim et al. | 415/173.1 |
| 2014/0119900 | A1 * | 5/2014 | Gurao et al. | 415/173.1 |

* cited by examiner

*Primary Examiner* — Kristina Fulton
*Assistant Examiner* — Eugene G Byrd

(57) ABSTRACT

A sealing band arrangement for a gas turbine including first and second adjoining rotor disks separated by a gap wherein the first rotor disk includes an aperture. The sealing band arrangement includes at least one seal strip segment located within the gap, wherein the seal strip segment includes a raised portion having a first mating surface. The sealing arrangement further includes a locking pin having a planar section for receiving the first raised surface. The locking pin also includes a pin section having a second mating surface that abuts against the first mating surface to thereby lock the locking pin and the seal strip segment together. Further, the pin section is located within the aperture to stop circumferential movement of the seal strip segment relative to first and second disks.

20 Claims, 5 Drawing Sheets

36

GAS TURBINE SEALING BAND ARRANGEMENT HAVING A LOCKING PIN

FIELD OF THE INVENTION

The invention relates to sealing bands used in gas turbines, and more particularly, to a sealing band arrangement that includes a locking pin having a locking pin mating surface that abuts against a mating surface of a seal strip segment to thereby lock the locking pin and the seal strip segment together wherein a portion of the locking pin is located within a disk rotor aperture to stop circumferential movement of the seal strip segment relative to rotor disks.

BACKGROUND OF THE INVENTION

In various multistage turbomachines used for energy conversion, such as gas turbines, a fluid is used to produce rotational motion. Referring to FIG. 1, a gas turbine 10 is schematically shown. The turbine 10 includes a compressor 12, which draws in ambient air 14 and delivers compressed air 16 to a combustor 18. A fuel supply 20 delivers fuel 22 to the combustor 18 where it is combined with the compressed air 16 and the fuel 22 is burned to produce high temperature combustion gas 24. The combustion gas 24 is expanded through a turbine section 26, which includes a series of rows of stationary vanes and rotor blades. The combustion gas 24 causes the rotor blades to rotate to produce shaft horsepower for driving the compressor 12 and a load, such as an electrical generator 28. Expanded gas 30 is either exhausted to the atmosphere directly, or in a combined cycle plant, may be exhausted to atmosphere through a heat recovery steam generator.

The rotor blades are mounted to disks that are supported for rotation on a rotor shaft. Annular arms extend from opposed surfaces of adjoining disks to form pairs of annular arms each separated by a gap. A cooling air cavity is formed on an inner side of the annular arm pairs between the disks of mutually adjacent stages. In addition, a labyrinth seal may be provided on an inner circumferential surface of stationary vane structures that cooperate with the annular arms to form a gas seal between a path for the hot combustion gases and the cooling air cavity. Each annular arm includes a slot for receiving a seal strip, known as a "belly band", which spans the gap between each annular arm pair to stop a flow of cooling air from the cooling air cavity into a path for the combustion gas 24. The seal strip may include multiple segments that extend in a circumferential direction and are interconnected at lapped or stepped ends.

During use, the seal strips may shift in a circumferential direction relative to each other. Shifting may cause one end of a segment to increase an overlap with an adjacent segment, while an opposite end of the segment will move out of engagement with an adjacent segment thus opening a gap for passage of gases through the seal strip. Therefore, an anti-rotation mechanism is provided for stopping circumferential shifting of seal strip segments.

An anti-rotation mechanism that is originally installed at the factory during assembly of a gas turbine exhibits wear after a prolonged period of turbine operation. In order to replace the anti-rotation mechanism with one of the same design, the rotor has to be de-stacked or disassembled which leads to undesirable downtime and increased cost for gas turbines that are currently in the field. Replacement anti-rotation mechanisms that do not require de-stacking of the rotor utilize welding operations to join mechanism components, require modification of a disk and/or are difficult to install. However, performing a welding operation or making modifications in the field is difficult and accidental welding of the disk during repair may occur.

SUMMARY OF INVENTION

A sealing band arrangement is disclosed for a gas turbine including first and second adjoining rotor disks separated by a gap wherein the first rotor disk includes an aperture. The sealing band arrangement includes at least one seal strip segment located within the gap, wherein the seal strip segment includes a raised portion having a first mating surface. The sealing arrangement further includes a locking pin having a planar section for receiving the first raised surface. The locking pin also includes a pin section having a second mating surface that abuts against the first mating surface to thereby lock the locking pin and the seal strip segment together. Further, the pin section is located within the aperture to stop circumferential movement of the seal strip segment relative to the first and second disks. The sealing band arrangement serves to seal a first air cavity from a second air cavity in the gas turbine.

Those skilled in the art may apply the respective features of the present invention jointly or severally in any combination or sub-combination.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
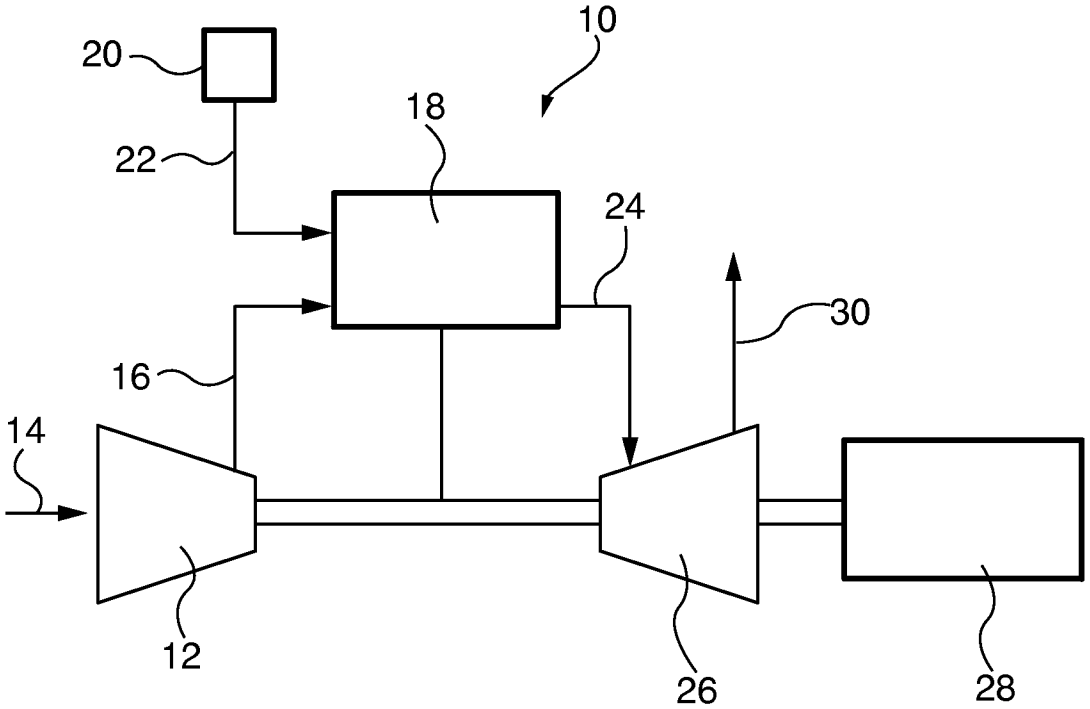
FIG. 1 PRIOR ART
FIG. 1 is a schematic representation of a gas turbine.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 2:
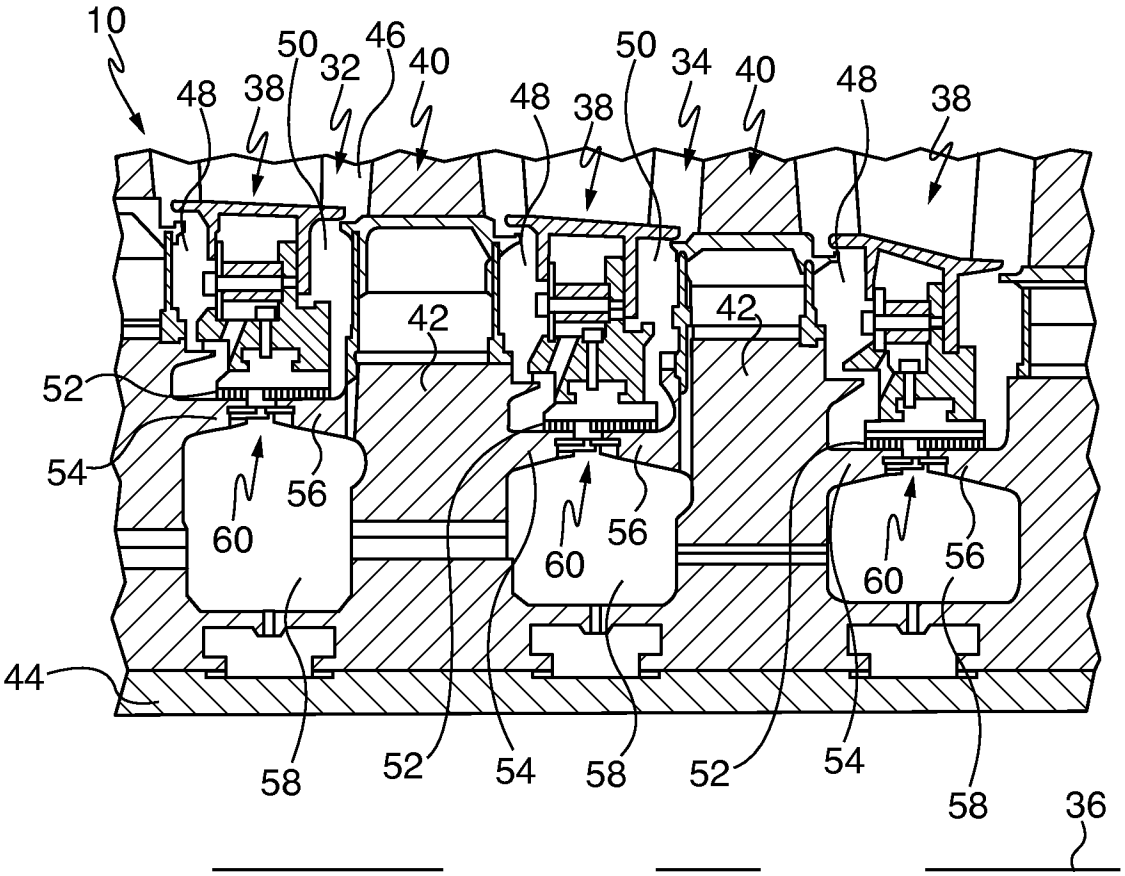
FIG. 2 is a partial cross sectional view of gas turbine.

Referring to FIG. 2, a partial cross sectional view of gas turbine 10 is shown. The gas turbine 10 includes adjacent stages 32, 34 oriented about an axis 36. Each of the stages 32, 34 includes a plurality of stationary vane assemblies 38 and a plurality of rotating blades 40. The vane assemblies 38 and blades 40 are positioned circumferentially within the gas turbine 10 with alternating arrays of vane assemblies 38 and blades 40 extending in an axial direction of the gas turbine 10. The blades 40 are supported on rotor disks 42 secured to adjacent disks with spindle bolts 44. The vane assemblies 38 and blades 40 extend into an annular gas passage 46. Hot gases directed through the gas passage 46 flow past the vane assemblies 38 and blades 40.

Disk cavities 48, 50 are located radially inward from the gas passage 46. Purge air is provided from cooling gas passing through internal passages in the vane assemblies 38 to the disk cavities 48, 50 to cool blades 40 and to provide a pressure to balance against the pressure of the hot gases in the gas passage 46. In addition, interstage seals including labyrinth seals 52 are supported at a radially inner side of the vane assemblies 38 and are engaged with surfaces defined on paired annular disk arms 54, 56 that extend axially from opposed surfaces of adjoining disks 42.

An annular cooling air cavity 58 is formed between the opposed surfaces of adjoining disks 42 on a radially inner side of the paired annular disk arms 54, 56. The annular cooling air cavity 58 receives cooling air passing through disk passages to cool the disks 42. A sealing band 60 or "belly band" seal is positioned between the annular cooling air cavity 58 and the disk cavities 48, 50. The sealing band 60 prevents or substantially limits the flow of gases between the cooling air cavity 58 and the disk cavities 48, 50.

Figure 3:
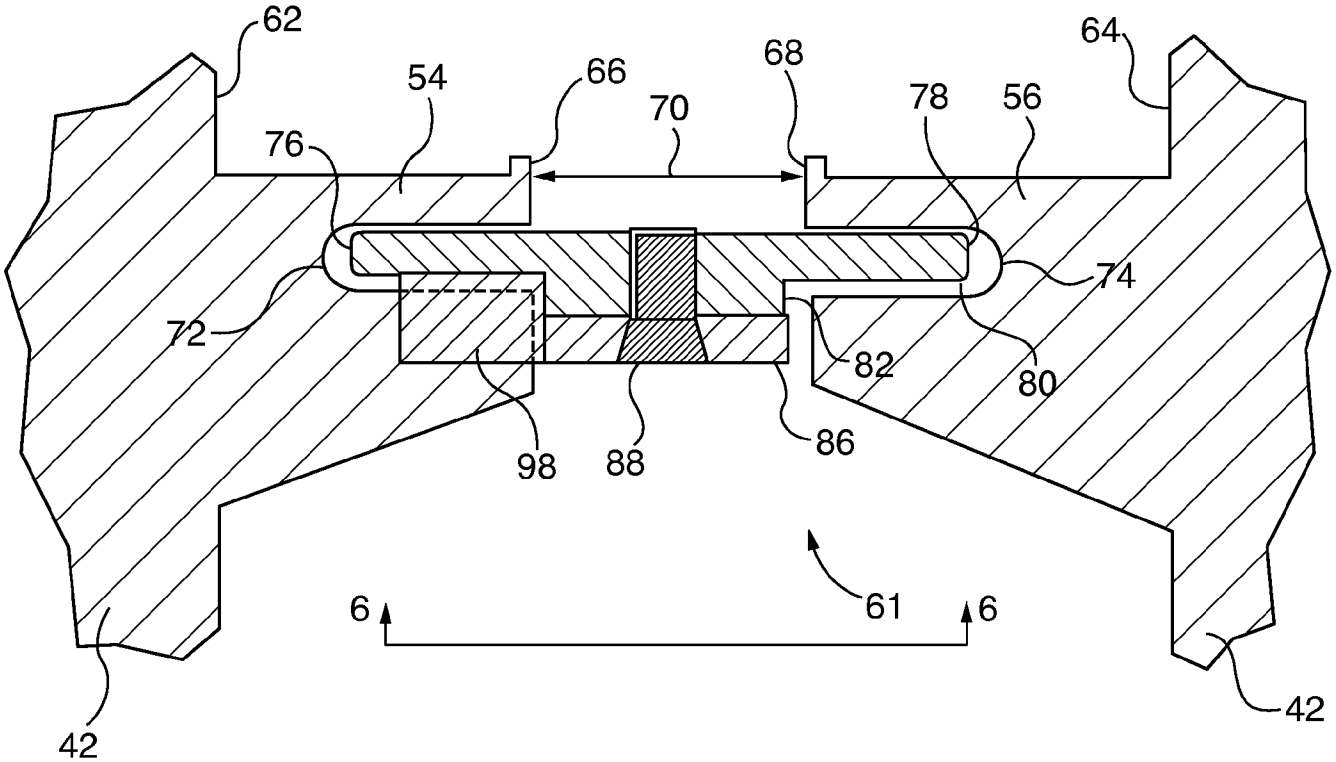
FIG. 3 depicts exemplary annular disk arms of adjoining exemplary disks and a sealing band arrangement in accordance with the present invention.

Referring to FIG. 3, exemplary annular disk arms 54, 56 of adjoining exemplary disks 42 and a sealing band arrangement 61 of the sealing band 60 are shown. The disks 42 and associated disk arms 54, 56 define an annular structure extending the full circumference about a rotor centerline. The disk arms 54, 56 extend from opposed surfaces 62, 64 respectively, of the disks 42. The disk arms 54, 56 include opposed end faces 66, 68, respectively, which are separated by an annular gap 70. A circumferentially extending slot 72, 74 is formed in the respective end faces 66, 68, wherein the slots 72, 74 are radially aligned with gap 70. The sealing band arrangement 61 includes a seal strip segment 80 having sealing band end portions 76, 78. The end portions 76, 78 are positioned within the respective slots 72, 74 such that the seal strip segment 80 spans the gap 70 between the end faces 66, 68. In an embodiment, the seal strip segment 80 is approximately 30 mm wide.

Figure 4:
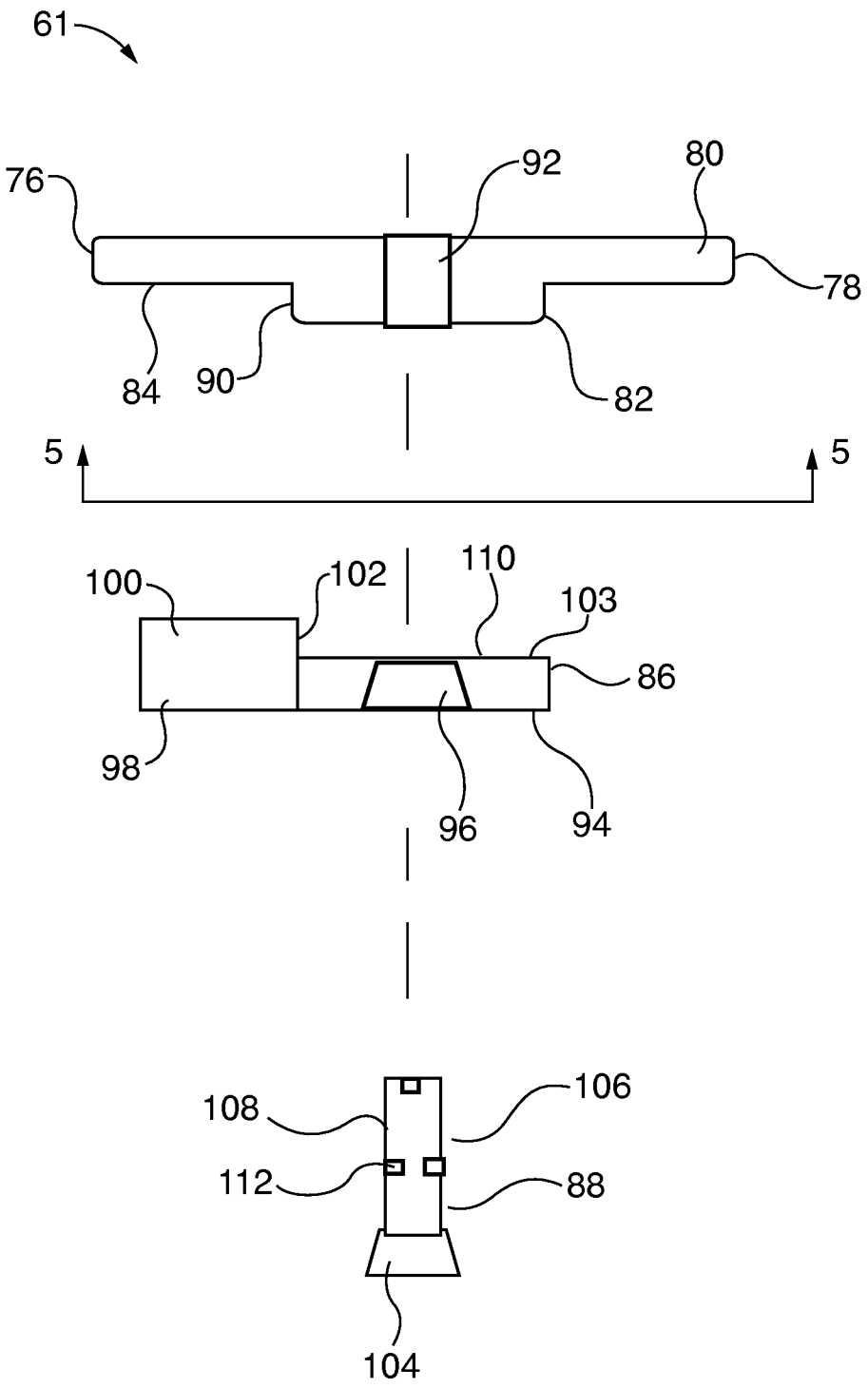
FIG. 4 is an exploded view of the sealing band arrangement.
Figure 5:
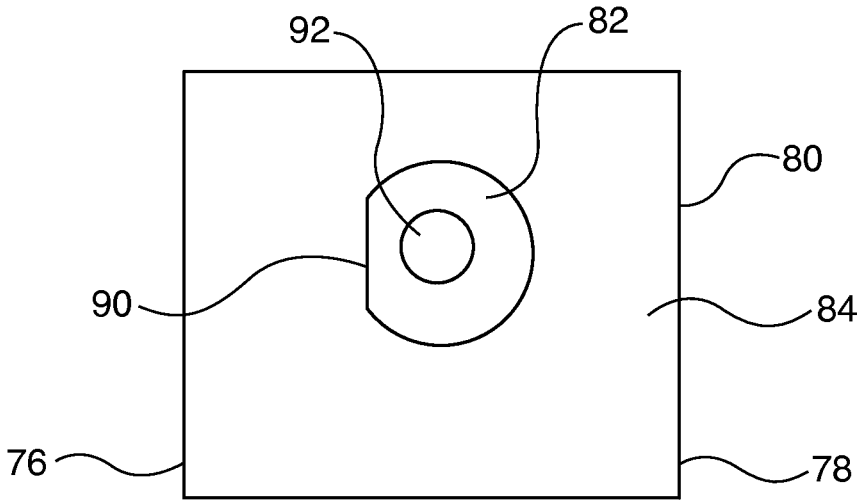
FIG. 5 is a bottom view of a seal strip segment along view line 5-5 of FIG. 4.

Referring to FIG. 4, an exploded view of the sealing band arrangement 61 is shown. The sealing band arrangement 61 includes the seal strip segment 80, a mating locking pin 86 and a fastener 88 for securing the locking pin 86 to seal strip segment 80. The seal strip segment 80 includes a first raised portion 82 that extends from a radially inner surface 84 of the seal strip segment 80. The first raised portion 82 and seal strip segment 80 may be integrally or unistructurally formed to form a one-piece configuration. Referring to FIG. 5, a bottom view of the seal strip segment 80 along view line 5-5 of FIG. 4 is shown. The first raised portion 82 includes a first mating surface 90 and a threaded hole 92. Referring back to FIG. 4, the locking pin 86 includes a recessed planar section 94 having a chamfered hole 96 and a pin section 98 located on an end of the planar section 94. The planar section 94 and the pin section 98 may be integrally or unistructurally formed to form a one-piece configuration. The pin section 98 includes a second raised portion 100 that extends above a radially outer surface 103 of the planar section 94. The second raised portion 100 includes a second mating surface 102 that abuts against the first mating surface 90 thereby locking the locking pin 86 and the seal strip segment 80 together when assembled. In addition, the first raised portion 82 contacts the planar section 94 when assembled. In one embodiment, the first 90 and second 102 mating surfaces are fiat although it is understood that other configurations may be used, such as cone shaped surfaces or angled surfaces that engage each other. The fastener 88 includes a fastener head 104 and a threaded portion 106. When assembled, the fastener 88 extends through the locking pin 86 such that the fastener head 104 sits within the chamfered hole 96 and the threaded portion 106 threadably engages the threaded hole 92 thereby securing the locking pin 86 to the seal strip segment 80. In addition, a high temperature thread sealant may be used on the threaded portion 106. In an embodiment, the locking pin 86 is located in a circumferential center portion of the seal strip segment 80 between ends of the seal strip segment 80. An excess section 108 of the threaded portion 106 that extends beyond a radial outer surface 110 of the locking pin 86 is then removed. In particular, the threaded portion 106 may include an undercut 112 to facilitate removal of the excess section 108.

Figure 6:
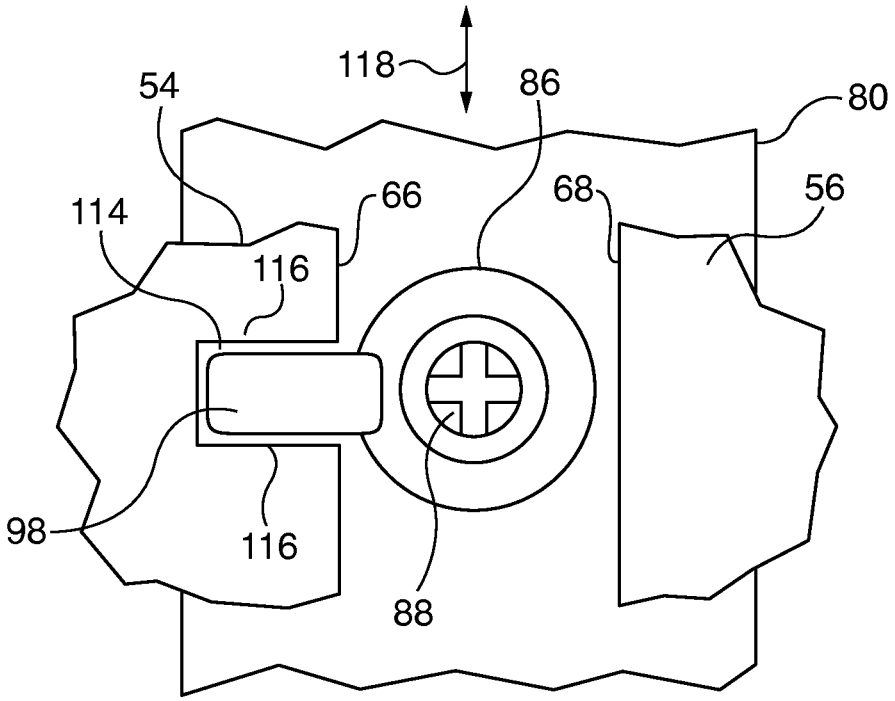
FIG. 6 is a bottom view of a locking pin along view line 6-6 of FIG. 3.

Referring to FIG. 6, a bottom view of the locking pin 86 along view line 6-6 of FIG. 3 is shown. The pin section 98 is located in a notch or aperture 114 formed in disk arm 54. In one embodiment, the pin section 98 and aperture 114 each have a rectangular shape, although it is understood that other shapes may be used such as a cone shape or other shapes that engage each other. Alternatively, the aperture 114 may be formed in disk arm 56. Contact between sidewalls 116 of the aperture 114 and the pin section 98 serves to constrain circumferential movement 118 of the pin section 98 relative to the disk arm 54. This also constrains circumferential movement 118 of the seal strip segment 80 due to contact between the first 90 and second 102 mating surfaces. Thus, the locking pin 86 and the first raised portion 82 serve as an anti-rotation device for inhibiting or stopping circumferential movement 118 or shifting of an associated seal strip segment 80. In accordance with the invention, a gas turbine may include a plurality of seal strip segments 80 each including the locking pin 86 and first raised portion 82 to inhibit or stop circumferential movement 118 of an associated seal strip segment 80. The seal strip segments 80 form a continuous sealing band 60 for preventing or substantially limiting the flow of gases between the cooling air cavity 58 and the disk cavities 48, 50. In one embodiment, four seal strip segments 80 are used.

Alternatively, the aperture 114 may be pre-existing, i.e. previously provided for engagement with an anti-rotation mechanism originally installed at the factory during assembly of a gas turbine. Thus, the present invention does not require machining or other modification to the arms 54 or 56. Therefore, the present invention enables field replacement of an existing anti-rotation mechanism and belly band seal.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sealing band arrangement for a gas turbine, wherein the gas turbine includes first and second adjoining rotor disks separated by a gap, comprising:

a seal strip segment located within the gap, wherein the seal strip segment includes first and second segment surfaces each oriented in a first direction wherein the second segment surface is spaced apart from the first segment surface to form a first raised portion that extends from the seal strip segment and wherein the first raised portion includes a first mating surface that is oriented in a second direction transverse to the first direction and wherein the first raised portion and the seal strip segment are unistructurally formed;

an aperture formed in either the first or second rotor disk; and a locking pin having a single pin section and a planar section wherein the pin and planar sections include first and second pin surfaces, respectively, wherein the first and second pin surfaces are each oriented in the first direction and wherein the first pin surface is spaced apart from second pin surface to form a second raised portion that extends toward the first raised portion, wherein the second raised portion includes a second mating surface that is oriented in the second direction and abuts against the first mating surface thereby locking the locking pin and the seal strip segment together and wherein the pin section is located within the aperture to stop circumferential movement of the seal strip segment relative to the first and second disks.

2. The sealing band arrangement according to claim 1, wherein the first raised portion extends from a radially inner surface of the seal strip segment.

3. The sealing band arrangement according to claim 1, wherein the first and second mating surfaces are flat.

4. The sealing band arrangement according to claim 1, wherein the seal strip segment and the locking pin are affixed by a fastener.

5. The sealing band arrangement according to claim 1, wherein the pin section has a rectangular shape.

6. The sealing band arrangement according to claim 1, wherein the locking pin is located in a center portion of the seal strip segment.

7. The sealing band arrangement according to claim 1, wherein the sealing band includes four seal strip segments.

8. The sealing band arrangement according to claim 1, wherein pin section is located on an end of the locking pin.

9. A sealing band arrangement for a gas turbine, wherein the gas turbine includes first and second adjoining rotor disks separated by a gap, comprising:

a seal strip segment located within the gap, wherein the seal strip segment includes first and second segment surfaces each oriented in a first direction wherein the second segment surface is spaced apart from the first segment surface to form a first raised portion that extends from the seal strip segment and wherein the first raised portion includes a first mating surface that is oriented in a second direction transverse to the first direction and wherein the first raised portion and the seal strip segment are unistructurally formed;

an aperture formed in either the first or second rotor disk;

a locking pin having a single pin section and a planar section for receiving the first raised surface wherein the pin and planar sections include first and second pin surfaces, respectively, and wherein the first and second pin surfaces are each oriented in the first direction and wherein the first pin surface is spaced apart from the second pin surface to form a second raised portion that extends toward the first raised portion, wherein the second raised portion includes a second mating surface that is oriented in the second direction and abuts against the first mating surface thereby locking the locking pin and the seal strip segment together and wherein the pin section is located within the aperture to stop circumferential movement of the seal strip segment relative to the first and second disks.

10. The sealing band arrangement according to claim 9, wherein the first and second mating surfaces are flat.

11. The sealing band arrangement according to claim 9, wherein the seal strip segment and the locking pin are affixed by a fastener.

12. The sealing band arrangement according to claim 9, wherein the pin section has a rectangular shape.

13. The sealing band arrangement according to claim 9, wherein the locking pin is located in a center portion of the seal strip segment.

14. The sealing band arrangement according to claim 9, wherein the sealing band includes four seal strip segments.

15. The sealing band arrangement according to claim 9, wherein pin section is located on an end of the locking pin.

16. A method for sealing a first air cavity from a second air cavity in a gas turbine, wherein the gas turbine includes first and second adjoining rotor disks separated by a gap, comprising:

providing a seal strip segment located within the gap;

providing a first raised portion on the strip seal segment by forming first and second segment surfaces on the seal strip segment each oriented in a first direction wherein the second segment surface is spaced apart from the first segment surface, and wherein the first raised portion extends from the seal strip segment and includes a first mating surface that is oriented in a second direction transverse to the first direction and wherein the first raised portion and the seal strip segment are unistructurally formed;

providing an aperture in either the first or second rotor disk;

providing a locking pin having a planar section for receiving the first raised surface wherein the planar section includes a first pin surface;

providing a single pin section having a second pin surface wherein the first and second pin surfaces are each oriented in the first direction and wherein the second pin surface is spaced apart from the first pin surface to form a second raised portion that extends toward the first raised portion, wherein the second raised portion includes a second mating surface that is oriented in the second direction;

locking the locking pin and the seal strip segment together by contacting the first mating surface with the second mating surface; and locating the pin section within the aperture to stop circumferential movement of the at least one seal strip segment relative to the first and second disks.

17. The method according to claim 16, wherein the first and second mating surfaces are flat.

18. The sealing band arrangement according to claim 16, wherein the seal strip segment and the locking pin are affixed by a fastener.

19. The sealing band arrangement according to claim 16, wherein the pin section has a rectangular shape.

20. The sealing band arrangement according to claim 16, wherein the locking pin is located in a center portion of the seal strip segment.

* * * * *